US010386029B1

(12) United States Patent
Laydera-Collins

(10) Patent No.: US 10,386,029 B1
(45) Date of Patent: Aug. 20, 2019

(54) SOLAR POWERED SUBMERGED LIGHTING SYSTEM

(71) Applicant: Imack Laydera-Collins, Benton, LA (US)

(72) Inventor: Imack Laydera-Collins, Benton, LA (US)

( * ) Notice: Subject to any disclaimer, the term of this patent is extended or adjusted under 35 U.S.C. 154(b) by 0 days.

(21) Appl. No.: 16/117,497

(22) Filed: Aug. 30, 2018

Related U.S. Application Data

(60) Provisional application No. 62/672,725, filed on May 17, 2018.

(51) Int. Cl.

| | |
|---|---|
| ***F21S 9/03*** | (2006.01) |
| ***F21V 31/00*** | (2006.01) |
| *F21Y 115/10* | (2016.01) |
| *F21W 131/401* | (2006.01) |

(52) U.S. Cl.
CPC ..... *F21S 9/035* (2013.01); *F21V 31/00* (2013.01); *F21W 2131/401* (2013.01); *F21Y 2115/10* (2016.08)

(58) Field of Classification Search
CPC .. F21S 9/03; F21S 9/032; F21S 9/0335; F21S 9/037; F21W 2131/401
See application file for complete search history.

(56) References Cited

U.S. PATENT DOCUMENTS

| | | | | |
|---|---|---|---|---|
| 7,753,576 | B2 * | 7/2010 | Marcinkewicz | B63B 45/02 362/101 |
| 7,887,214 | B2 * | 2/2011 | Chang | F21K 9/00 362/157 |
| 9,470,413 | B2 * | 10/2016 | Li | F21V 33/006 |
| 2005/0237741 | A1 * | 10/2005 | Chang | A47H 13/00 362/249.01 |
| 2008/0062690 | A1 * | 3/2008 | Ip | F21S 6/002 362/249.12 |

* cited by examiner

*Primary Examiner* — Robert J May

(57) ABSTRACT

The object of the present invention is a solar powered submerged lighting system that is self-contained, waterproof and provides underwater lighting during the nighttime. The system contains a solar cell array for charging a battery and electronic elements to control the transmission of the battery power towards a set of LED lights in the absence of solar light. The LED lights contain light projectors to improve the light penetration through the water body.

18 Claims, 10 Drawing Sheets

SOLAR POWERED SUBMERGED LIGHTING SYSTEM

CROSS-REFERENCE TO RELATED APPLICATIONS

This application claims the benefit of U.S. Provisional Patent Application No. 62/67,253, filed May 17, 2018, which is hereby incorporated by reference.

FIELD OF THE INVENTION

The present invention has its niche in pool lighting systems and other bodies of water where lights are used as decorations.

BACKGROUND OF THE INVENTION

Various types of decorative fixtures are currently used in the swimming pool, spa and fountain industry. These fixtures are made in a large variety of forms, shapes and sizes. For example, some common fixtures are decorative rosettes, wall sconces, spill bowls, whimsical characters and the like. In many applications these fixtures interact with water, and others are located in close proximity to the water. Some of these fixtures contain lighting elements. Lighting decorative fixtures are typically wired with low voltage current to avoid electrical shock when wet. Typically, wired pool lighting is installed within the pool walls using sealed assemblies and low voltage lamps. This makes the changing of assemblies unfriendly and very delicate since it is done underwater and seals have to be maintained. These problems become more evident with salt water pools since the salt water is corrosive and is an electrical conductor.

Alternative lighting systems incorporate LEDS outside the pool with a central control unit to create light effects. These systems are fine while there is no traffic around the pool since they could become a trip hazard. Most recently there has been marketed assemblies which include a sealed tube that is inserted from the top of the pool deck and shines over a clear window on the pool wall. This makes the lamp replacement a lot easier, but it has to be built on new construction projects. Other systems include floating LEDs which are battery charged. Unmistakably, the common battery powered floating LEDs do not have enough power since they are designed to have a very low drain so the typical battery can last longer, and they may not be the special kind of LEDs with the wavelength in the low spectrum for better propagation in the water.

It is also common to find pools with no underwater lights; unfortunately the post-construction installation of these wired lighting systems is nearly impossible and inpractical. In some cases the typical landscape lighting fixtures are used around the surrounding areas without traffic, such as waterfalls or landscaping islands. Unfortunately, these typical landscaping lamps cannot be used on open perimeter pools since they will be an obstacle and nuisance to pool users.

On above ground pools, wired underwater lighting is available as an aftermarket fixture. The installer would have to cut the pool wall and the liner to install the fixture. This process is out of reach for the non-DIY pool owner due to the tools needed and skills involved. Therefore, it is obvious then that there is a need for an affordable pool lighting system that could be incorporated on any pool, spa or fountain, which is safe, very simple to setup, long lasting, doesn't require power hook-up nor battery replacement and that can provide a pleasant lighting effect inside these bodies of water.

BRIEF DESCRIPTION OF THE INVENTION

The drawbacks encountered in the prior art are solved by the present invention which provides an innovation in the form of a wireless portable pool lighting system that is affordable, reliable, safe, easy to install, and can provide light effects during the nighttime on bodies of water such as pools, fountains and spas, without the problems of blocking swimmers activity areas, difficult installation, or replacing batteries. The invention consists of a ground supported solar battery charging system attached to a submerged lighting structure in two conjoined individual or common structures. One structure is the support base which will sit on a surface at the edge of a body of water, and a second structure suspended from the support base that penetrates the body of water exposing lighting elements underwater. The design in two conjoined structures is dictated by the function of each of these structures. The supporting base function is to provide a housing for the few elements of the electronic system and to serve as an anchoring element for the suspended structure. Since the supporting base must be located off the water, but at the edge of the water surface, it must be compact enough to avoid being an obstacle for pool users and must be resilient enough to withstand humans stepping on it as well as providing the required area for the solar cells array necessary to provide the required charging load for the battery. This supporting base must be relatively heavy and with gripping structures underneath to provide the maximum possible grip to the poolside surface. The supporting base surface in contact with the poolside surface will benefit by having small and shallow cylindrical protrusions or bumps to avoid the water puddling underneath which would reduce gripping strength. The basic function of the suspended curtain is to hold in place a strip of LEDs underwater without being destroyed or ripped by swimmers and to blend with the water and walls of the pool for aesthetical purposes. Having these parameters in mind, the suspended curtain must be made from a clear and soft material, resilient to withstand any contact with humans inside the pool and with a reduced water surface footprint in proximity to the pool internal walls. Also, the LEDs will be preferable of high intensity, low wavelength and low power consumption. In addition to these LEDs properties the light must be focused into a beam capable of penetrating into the water body.

Since the system will be exposed to sunlight during the daytime, the incorporation of electronic elements and conductors will make possible to manage the interconnections required to detect sunlight and to switch from battery charging mode to light powering mode. During nighttime, the electronic elements connect the battery to the lighting elements. Lighting systems operating this way are common in the marketplace as landscape lights and other decorative fixtures that provide lighting effects during the nighttime. The differentiation between these prior art lighting systems and the underwater lighting system of the present invention comes in the form of the two conjoined elements which are fully waterproof structures that are function specific and provide a superior light intensity capable of propagating underwater to create an illuminated zone within the limits of traditional pools. Characteristics of direct and diffuse illumination are governed by practical and physical limits related to a wide range of parameters. These parameters contribute to attenuation of the light by absorption and scattering phenomena, which exhibits a strong relationship to the wavelength of the light and the beam angle of the light source. Certain type of LEDs in the lower range of wavelength are specifically designed for optimal underwater lighting propagation due to its physical characteristics. With that in mind, the system must provide the most effective illumination at the lowest possible battery drainage value. To achieve that condition while providing the desired underwater illumination effect, the light scattering should be maintained at a minimal angle to reduce the attenuation as much as possible, this is the reason for which the LED's light needs lenses or reflecting projectors to concentrate the light emitted by the LEDs into fairly straight beams.

Doing a basic math for calculating the feasibility of the system, in the typical area for the target floor mat 16" long×12" wide (192 square inches) is possible to fit a solar cell array that produces 40 watts per hour. In a group of flat batteries for half of that area it is possible to pack 6000 mAh at 12 Volts. With this combination, the battery pack could be fully charged in less than 6 hours of sunlight exposure. Calculating the possible power output for high density LED we would have that they are capable of draining at 32 watts/hr. to fully discharge the battery and assuming we use LED strip that produces 200 Lumens per watt, we could possible produce 6400 lumens during a 6 hour period. Obviously this luminosity power exceeds the required power to illuminate the typical body of clear water, mainly when projectors are used to concentrate all that luminosity in light beams. In systems where cost savings are important, the solar cells size and battery capacity could be reduced by using cycling LED strips where an electronic control will turn on one LED at a time at a speed that all LEDs in the strip are perceived as a solid bar of lights. Also the changing speed could be reduced and use the result as a linear motion effect. This will result is less solar cells and less battery power, therefore less manufacturing cost.

The system object of the present invention offers the pool owner the convenience of placing an underwater care free lighting system that does not need wiring, battery replacement or maintenance of any type that could provide the same lighting characteristics of the typical wired systems. For open perimeter pools where the typical lighting fixture could be kicked, stepped on, destroyed or removed, the system object of the present invention provides a very disguised floor mat-like element as a supporting structure that could be placed at the edge of the pool and can be stepped on, it will have sufficient low profile that it will not be an obstacle for any of the typical activities performed around open perimeter pools. Such a mat or supporting base contains an array of flexible solar cells and photocells protected by a layer of clear and tear resistant material, therefore allowing solar light to pass through it while protecting the solar cells and electronics integrity. Also embedded into the low-profile mat will be embedded the low-profile high-power density battery and the required electronic components necessary to switch the battery from charging to lighting powering mode. The preferred material for the mat is a rubber-like elastomeric material that is heavy and provides enough frictional resistance to avoid being displaced easily, it will also provide the required support for the suspended lighting elements and potential moving forces like foot kicks, waves and splashing. The suspended curtain is a clear and soft plastic curtain like structure that is attached to one side of the supporting body or mat. Alternatively, the curtain material may be opaque and colored in a color that matches the surrounding environment. The side from which the suspended structure hangs from the supporting base is the edge in the proximity of the water.

The suspended curtain must be long enough to expose an array of low voltage and very compact lights placed at its lower edge, below the water line which is typically between 4" and 10" below the coping or supporting surface. The suspended curtain could be a solid sheet of material or opened like a net to avoid excessive motion caused by water motion inside the pool and to be disguised for aesthetic purposes. The net size should be small enough to avoid human finger penetration. In either case, the conductors and lighting elements will be fully embedded into the material to avoid contact with the water. At the bottom edge of the clear suspended curtain is where the lighting elements are located. The lighting elements are in the form of a flexible strip of LEDs since they are very compact and use low voltage, low current power.

Since the special underwater LED lights require more current than regular air exposed LEDs to be able to penetrate the water body with minimal attenuation, the LED's strip will be preferably outfitted with light projecting elements, such as reflecting or refracting lenses. These light projecting elements will aid in concentrating the emitted light in light beams with a low scattering coefficient capable of reaching the desired distance with the body of water. Since the array of LED lights are to be powered by a very compact battery, the arrangement of all the elements must be superior to typical wired lighting systems to be capable of providing an underwater strong beam of light. The relatively large solar cell exposure surface provides the advantage of providing enough charging power for the battery, which could be used for transmitting more power into the LEDs for stronger light beams. All these lighting structures, along with electrical conductors, are embedded into the plastic structure of the suspended curtain and connected to the solar cells and battery on the floor mat like supporting base. When the material required for the suspended curtain is different than the material used for the supporting body, the two parts could be joined by fusion, glue or mechanical attachment. Alternatively, when both parts are manufactured using the same material no joining system is necessary.

When the pool is not an open perimeter pool, like those having waterfalls, water fountains or plants in a portion of the perimeter, then the supporting body is typically out of the way of the pool users and could be anything that provides the basic function of the supporting base, such as a reasonable surface area of solar cells array exposed to sunlight, a housing for the electronic elements and the rechargeable battery and must be somewhat heavy to provide a strong anchoring structure for the suspended curtain. It will preferably will be a waterproof structure that blends in with the environment, such as a turtle shaped supporting base with solar cells over the shell surface with the suspended curtain attached to its feet. Under these conditions, the supporting base could be rock-shaped, plant-shaped, animal-shaped, etc. With these alternate configurations, larger batteries could be used and with high efficiency solar cells spread over the supporting base surface a more powerful system could be created for gathering solar light during the daytime and providing a high current voltage to the LEDs along the bottom edge of the suspended curtain submerged under the water line. With the abundant internal room within a bulkier supporting base, it is possible to add electronic elements that produce light and sound effects and illuminating the supporting base surface.

The system provided does not need any hardware of connections and can be easily placed around any pool edges to provide nighttime underwater lighting effects. It is also possible to secure the suspended curtain to the pool walls using suction cups, which will not fit all conditions since they require a smooth finish on the walls. On another popular type of backyard pools such as the above ground pools, the wireless pool lighting system object of the present invention could be easily installed by using the same flat mat or supporting base and affixing it to the metallic top rail or an external wall of the pool with adhesive in a preferred location where sunlight exposure is plentiful. Of course, many variations could be made from the preferred embodiments without departing from the essence and spirit of the invention. For example, if desired, the curtain like suspended element could be made short enough to allow the lights right above the surface of the waterline, providing light effects using the reflective surface of the water, in which the LEDs may not need projecting lenses since light will propagate with substantially less attenuation through the air.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments, and to explain various principles and advantages in accordance with the present invention. Advantages of the embodiments of the present invention will be apparent from the following detailed description of the exemplary embodiments thereof, which should be considered in conjunction with the accompanying drawing in which.

DETAILED DESCRIPTION OF THE INVENTION

Figure 1A:
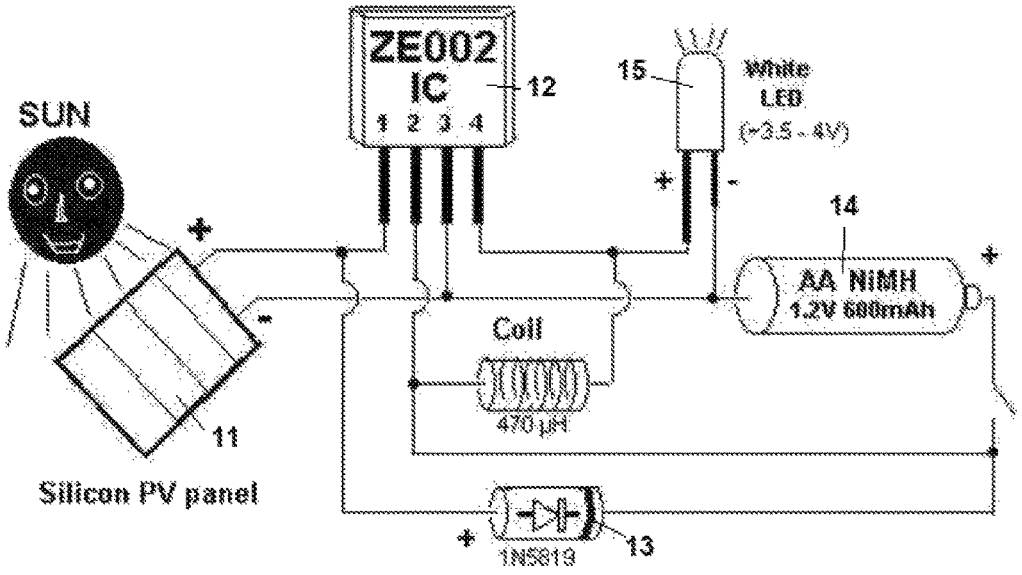
FIG. 1*a* is a schematic showing the elements of the prior art included in the invention.

Detailed embodiments of the present invention are described herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Alternate embodiments may be devised without departing from the spirit or the scope of the invention. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

As used herein, the terms "a" or "an" are defined as one or more than one. The term "plurality," as used herein, is defined as two or more than two. The term "another," as used herein, is defined as at least a second or more. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including," "having," or "featuring," as used herein, are defined as comprising (i.e., open language). The term "coupled," as used herein, is defined as connected, although not necessarily directly, and not necessarily mechanically. As used herein, the term "about" or "approximately" applies to all numeric values, whether explicitly indicated. These terms will typically mean a numerical value which is approximate and whose small variation would not significantly affect the practice of the disclosed embodiments (i.e., would have the same function or result). For example, where a numerical value is provided, unless indicated otherwise by the context, the use of relative terminology such as "about" or "approximately" should be construed to mean that the numerical value can vary by +/−5%, +/−10%, +/−15%, or even possibly as much as +/−20% in certain embodiments whereby the variance would provide the same function or result. Relational terms such as first and second, top and bottom, right and left, and the like may be used solely to distinguish one entity or action from another entity or action without necessarily requiring or implying any actual such relationship or order between such entities or actions.

FIG. 1*a* is a schematic of the current art showing the necessary electronic elements to be included in the invention in the simplest form. As we could learn, an array of solar cells 11 is connected to a current control device 12, in this case an integrated circuit ZE002. The current control device 12 receives input from a light detecting diode or photocell 13. During daytime and solar exposure, under the input of the photocell 13, the integrated circuit 12 manages to connect the current produced by the solar cells array 11 to the battery 14. During the nighttime the light detecting diode 13 sends a signal to the current control device 12 to switch the current flow from the battery 14, towards the LED lights 15. This is clearly a well-known art utilized in many decorative solar landscape lights which is utilized in the present invention to provide a novice poolside wireless lighting system that provides many conveniences for the end user.

Figure 1B:
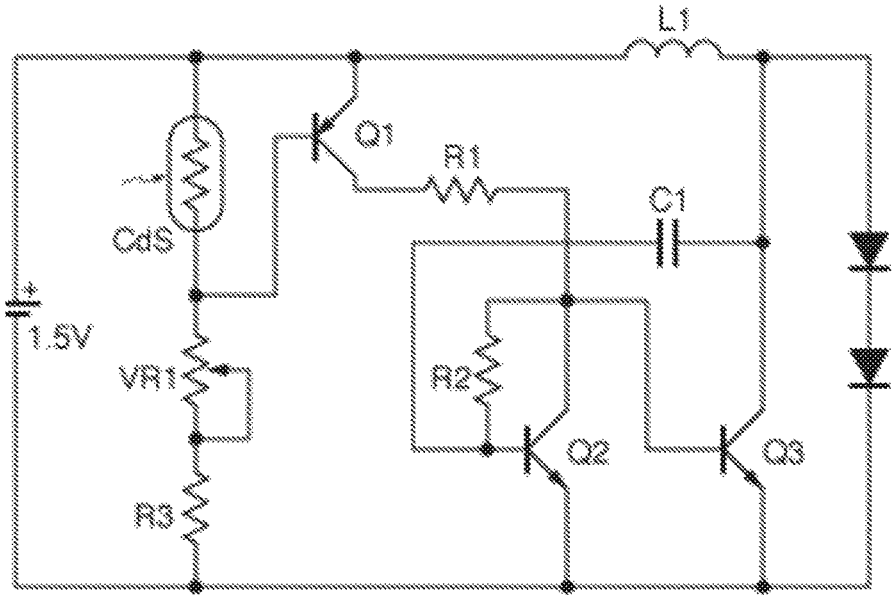
FIG. 1*b* is a typical electronic schematic for a typical solar powered LED

In some instances the current control device 12 can also be replaced by electronic circuits such as the one represented in FIG. 1*b*, where many variations are possible depending on the type of lights and effects to be implemented.

Referring to FIGS. 2*a*, 2*b*, 2*c* and 2*d*, a preferred embodiment of the poolside portable lighting system 10 of the present invention is depicted as a perspective view. This embodiment consists of a supporting base 21 which is in the shape of a floor mat made of a rubber-like material containing a group of recessed solar cells 11 forming an array. The solar cells 11 are covered by a clear sheet of clear plastic 16 flushed with the upper surface of the supporting base 21. This clear plastic cover 16 protects the electronic components from moisture and at the same time protects the photocells 13 from ripping and wear as pool users may walk over them. Under the clear sheet of plastic is also located the light detecting diode or photocell 13. Also embedded into the supporting base 21 is a flat battery 14 or group of flat batteries 14 and the current control device 12 previously described on FIG. 1 to control the path of the electrical current (not shown). Attached to an edge of the supporting base 21 is a clear plastic suspended curtain 22. The suspended curtain 22 hangs from the supporting base 21 which serves as an anchoring surface. At the lowest end of the suspended curtain 22 is a group of lighting elements 20. These lighting elements 20 are to be positioned under the water surface 39 and are embedded into the material of the suspended curtain 22 fully protected from water contact. In special cases these lighting elements 20 may consist of only one lighting element if desired.

Figure 3:
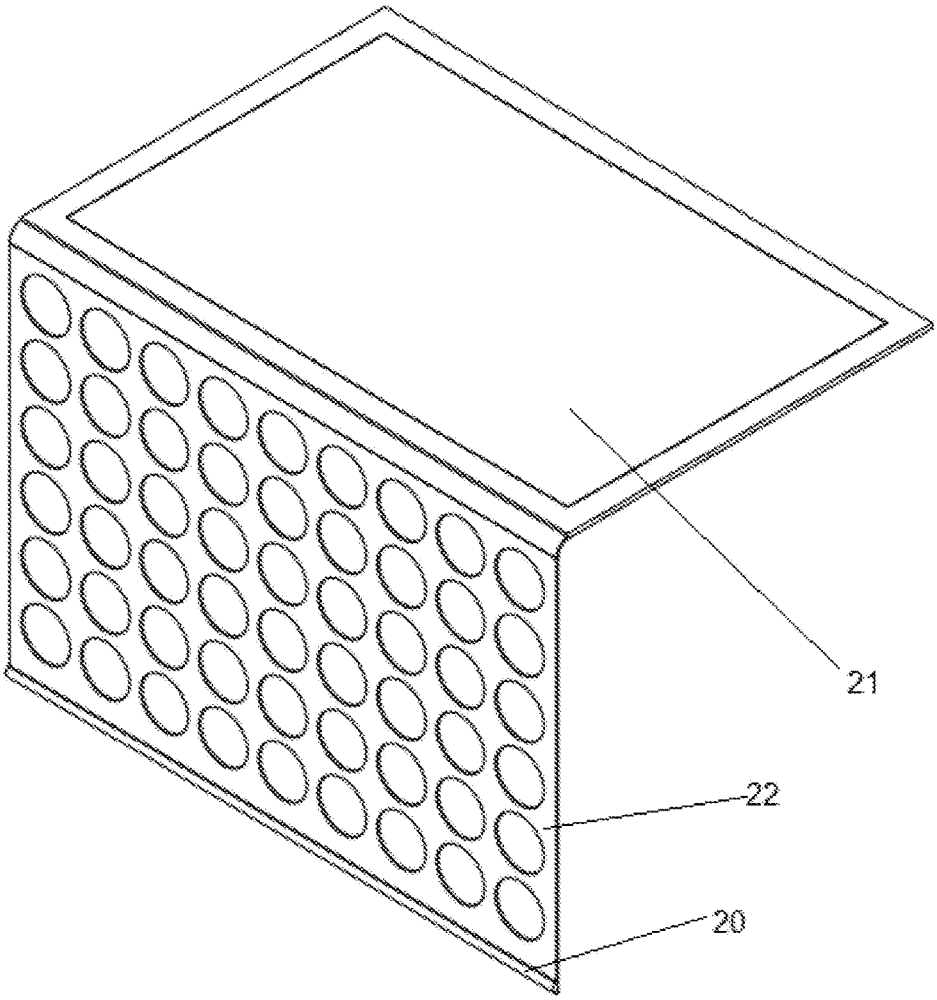
FIG. 3 is a perspective showing the portable lighting system object of the present invention where the suspended curtain has perforations.
Figure 4A:
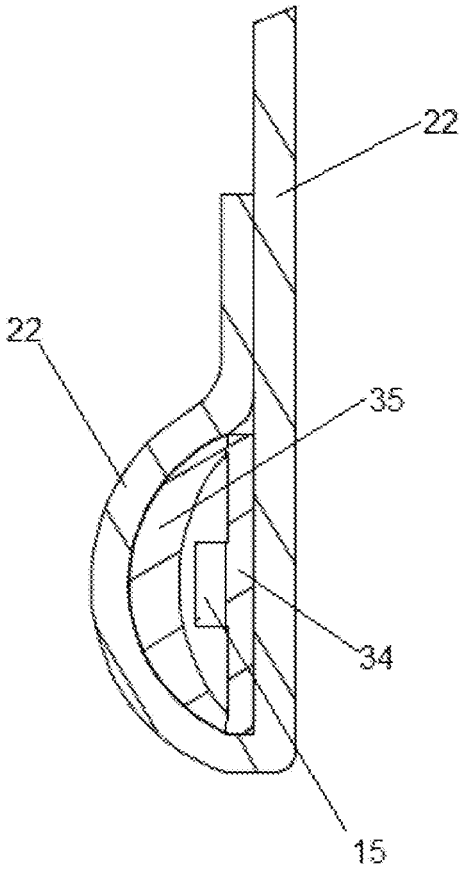
FIG. 4*a* is a sectional view showing the internal components of the basic lighting element.
Figure 4B:
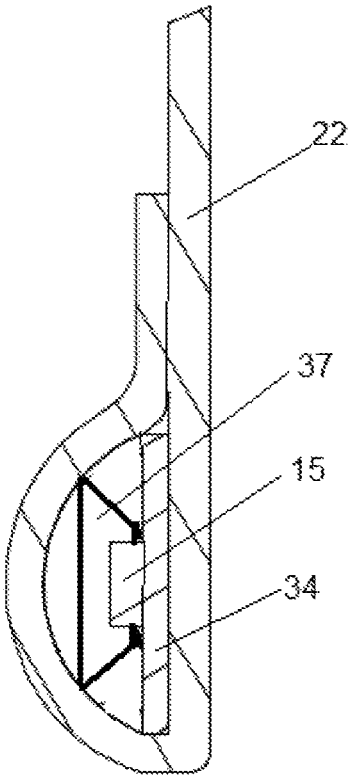
FIG. 4*b* is a sectional view of the lighting element in the form of a LED strip with projecting mini-mirrors.

The conductors carrying the power from the battery towards the lighting elements 20, are also embedded into the suspended curtain 22 and fully protected from water contact as they extend into the supporting base 21 where the electronic control system 12 (not shown) solar cells 11 and the battery 14 are located. The preferred battery 14 utilized in this application is a high-power density Lithium-Ion flat battery with low current drainage like those utilized in cell phones. The battery 14 low profile shown in FIG. 2*b*, allows to embed them into the supporting base 21 under the solar cells array 11 without compromising its functionality and integrity since it will be protected by the materials of the supporting base 21. The suspended curtain 22 is shown as a solid sheet of material in FIG. 2*a*. Another way to carry out this invention is by providing a perforated, or net shaped suspended curtain 21 to allow water circulation around through the suspended curtain 21, therefore making it more stable under water movement. This is depicted by FIG. 3. The supporting base 21 is preferably a molded rubber-like thermoplastic structure with pockets where the electronic components could be encapsulated using special glue or compounds matching the same color of the supporting base 21 material. To avoid the formation of wet pockets under the supporting base 21 that could reduce its grip against the supporting surface, small projecting bumps 29 are molded into the lower face 28 of the supporting base 21. These projecting bumps 29 keep the flat surface of the lower face 28 of the supporting base 21 away from the water that may puddle between the supporting body 21 and the supporting surface 33. The supporting base 21 may also be attached to the supporting surface 33 by a light-adhesive compounds or putty-like compounds to improve the adhesion to the edge of the supporting surface 33 and to avoid water puddling. The suspended curtain 22 may also contain suction cups or semi-adhesive compounds to secure the clear curtain 21 to the pool walls. The suspended curtain 22 is preferably manufactured of a clear and flexible sheet of plastic which could be folded and thermally fused for sandwiching the lighting elements 20 assembly as shown by FIG. 4*a*.

Figure 4C:
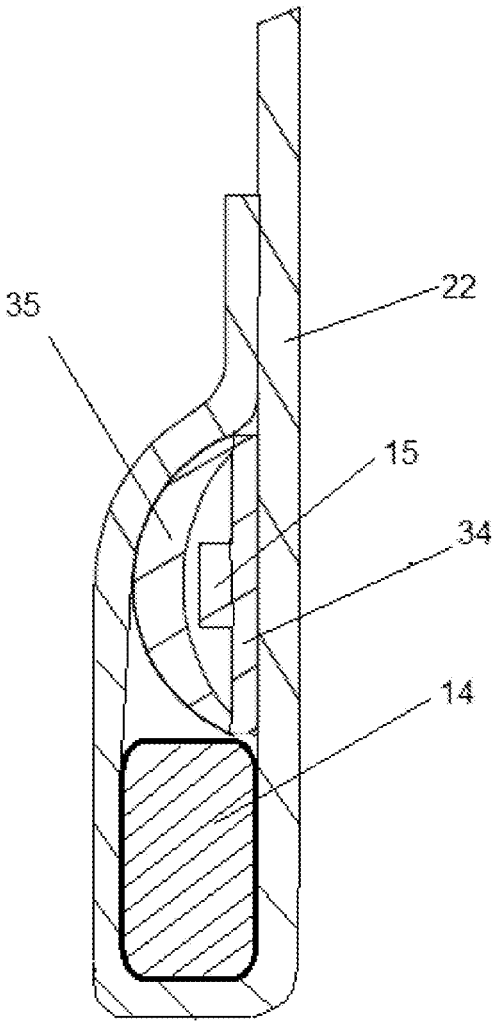
FIG. 4*c* is a sectional view of the lower section of the suspended curtain showing an alternate location for the battery.

FIG. 4*c* shows an alternate location for the battery 14, contained below the lighting elements 20 assembly. On this embodiment, the only advantage will be the added weight over the clear curtain 22 that may help to maintain the lighting elements 20 in position under water. If necessary counterweights could be used instead of the batteries 14. The complete system is low voltage, therefore there will not be electrical hazards for the end user.

Figure 2A:
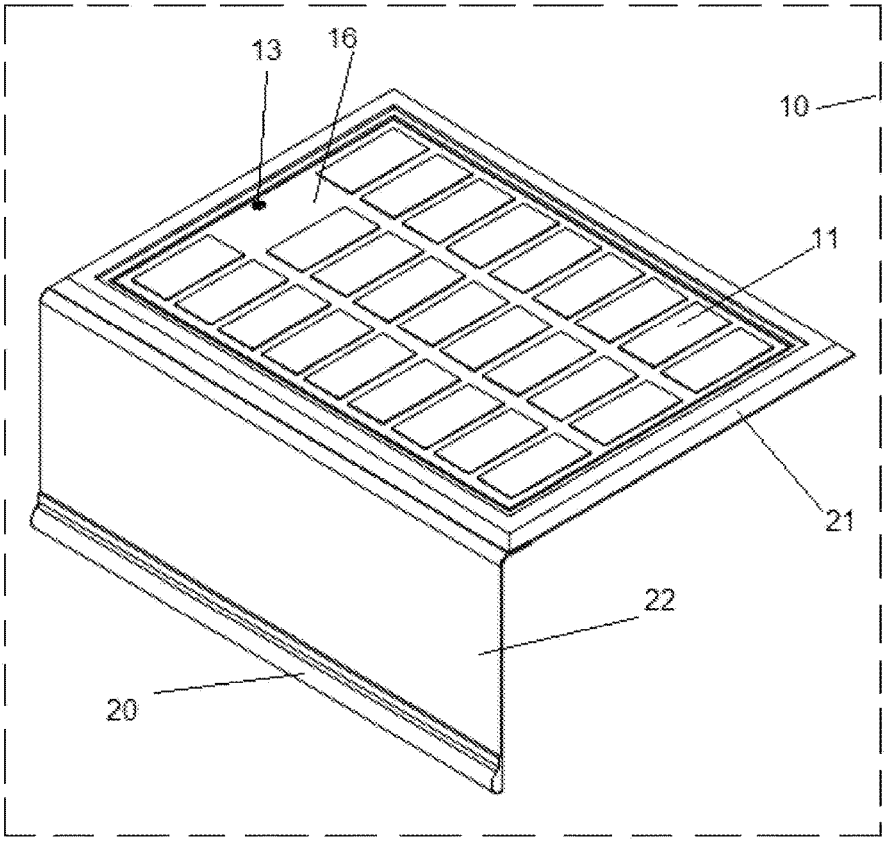
FIG. 2*a* is a perspective illustration of the preferred configuration of the present invention.
Figure 2B:
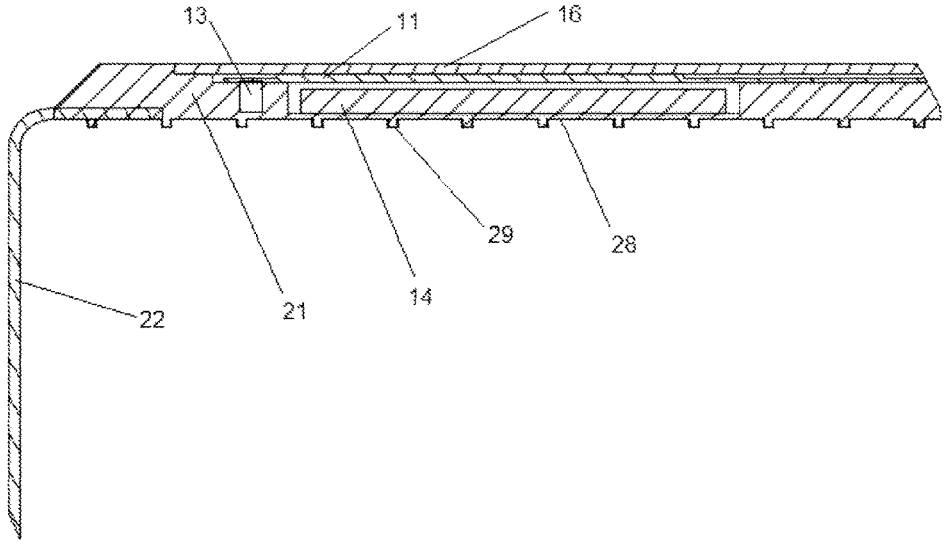
FIG. 2*b* is a cross section of the supporting base showing the internal elements.
Figure 2C:
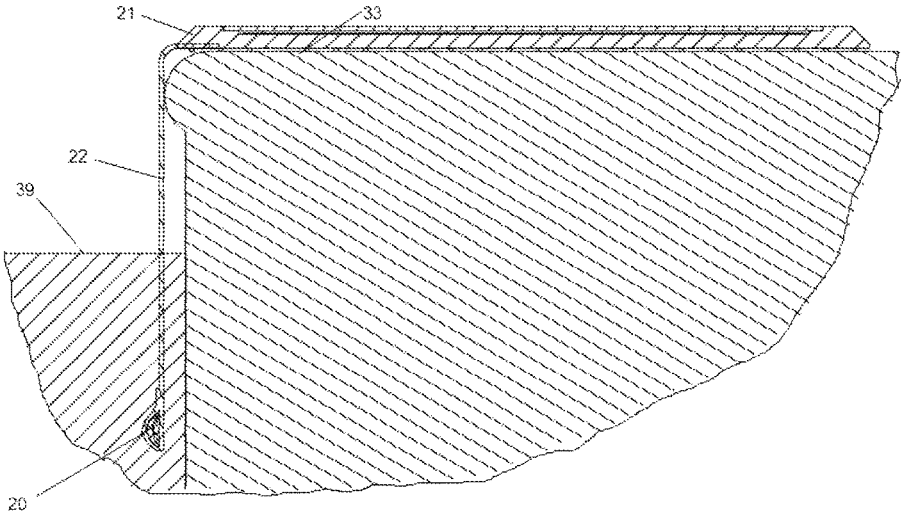
FIG. 2*c* is a cross section showing the typical placement of the portable lighting system of the present invention.
Figure 2D:
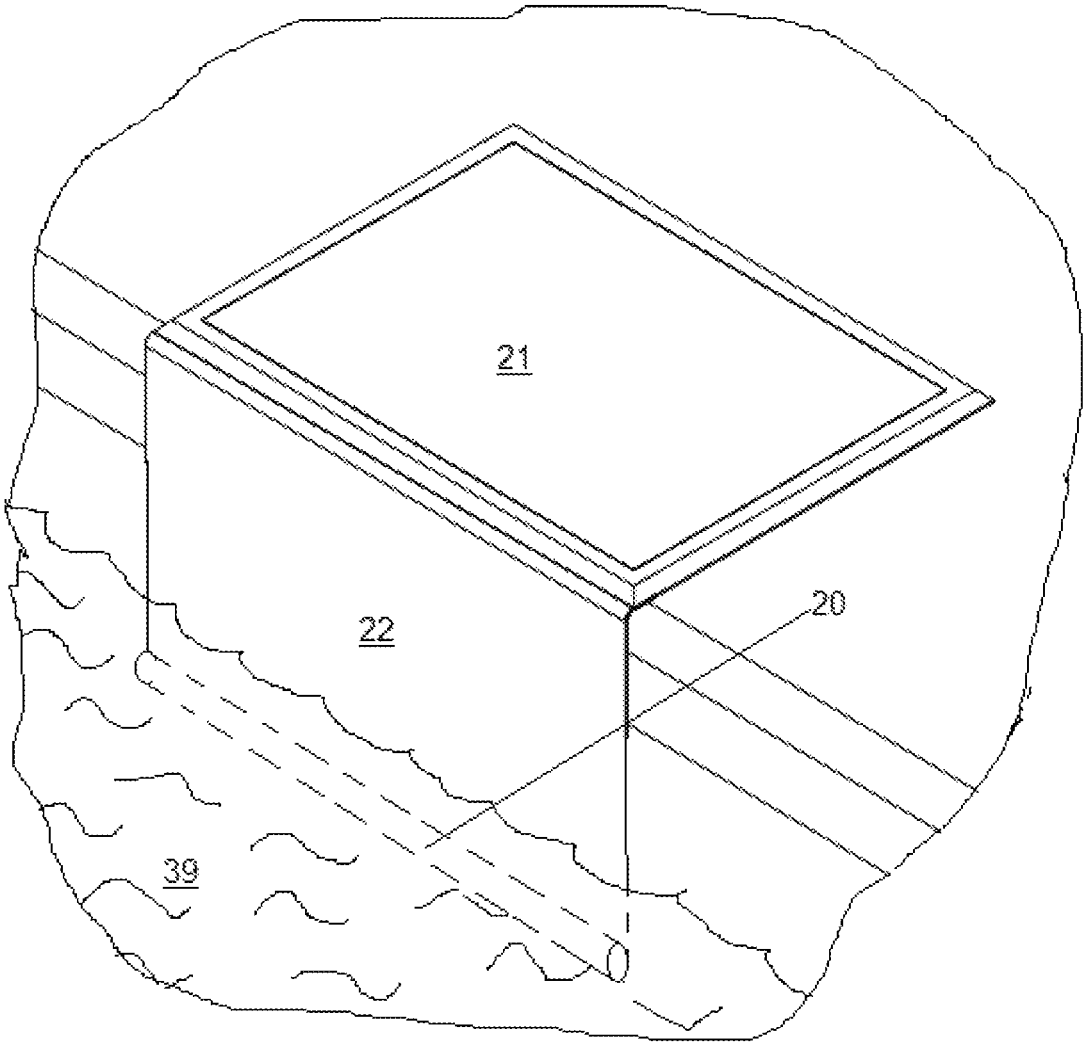
FIG. 2*d* is a perspective showing the poolside lighting system object of the present invention installed on the top edge of a typical pool.
Figure 5:
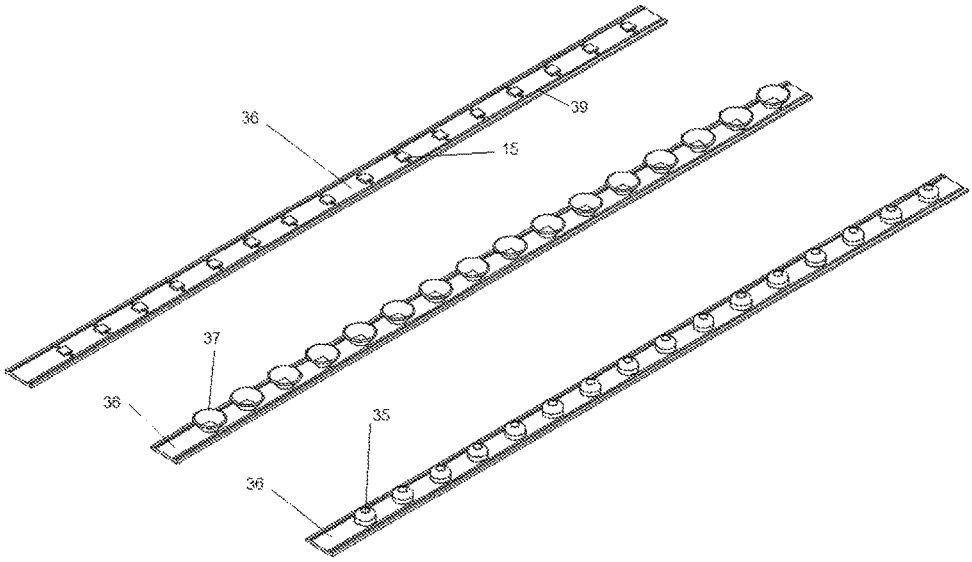
FIG. 5 is a perspective view showing three different types of LED strips.

As depicted by FIGS. 4*a*, 4*b*, 4*c* and 5 the lighting elements 20 shown in FIG. 3 are comprised of several components including a holding board 34, which is a printed circuit board containing the LEDs 15 and interconnecting circuits 39. The holding board 34 and the LEDs 15 form what is commercially supplied as a LED strip 36. These LED strips 36 are manufactured in rigid or flexible strips for various types of applications. For the purposes of the present invention, the flexible type LED strip 36 is preferred since it will be more resistant to shocks and deformation. The light produced by these high intensity LEDs 15, is concentrated and projected into the water body by the lenses 35, which are placed on the front of the LED lights 15. The manufacturers of LED assemblies or LED strips 36 also offer reflecting mini-projectors 37 that are located around the LED lights 15, which is alternatively used on the lighting elements 20 assembly for projecting the LED light into the water body 39 as depicted by FIG. 2*c*. The LED strip 36 is fully embedded into the material of the clear curtain 21 and it is fully protected from water contact. FIG. 5 depicts the different types of LED strips 36 available in the marketplace that are suitable for the lighting elements 20 shown by FIG. 2*a*.

Alternate applications of the present invention include placing the lighting elements 20 slightly above the water surface to use the reflective surface of the water as means of light motion. This application will not require the use of lower wavelengths as required for underwater applications.

Figure 7:
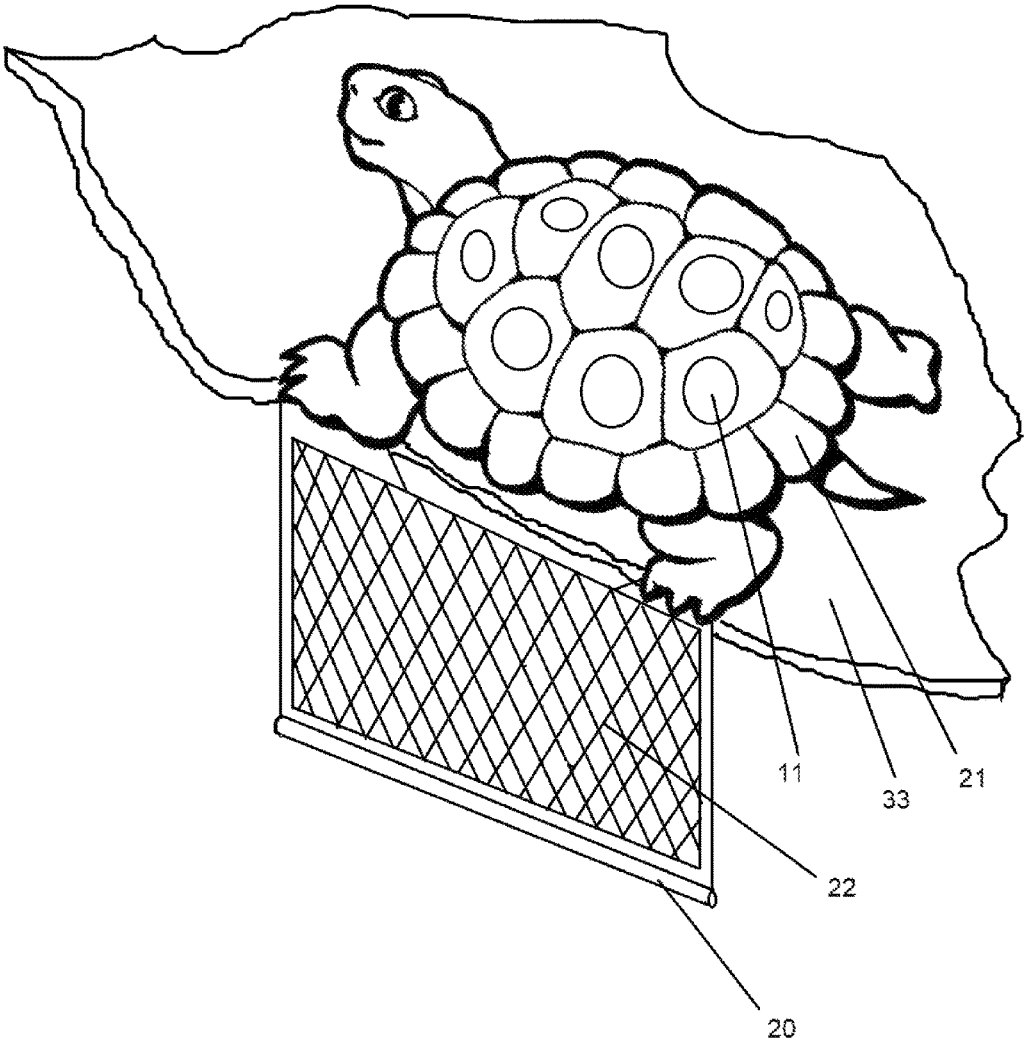
FIG. 7 is a perspective view showing a tortoise sculpture replacing the supporting base and a net shaped suspended curtain.

FIG. 7 shows another embodiment of the present invention, where the supporting base 21 is replaced by a bulky body with enough weight to anchor the suspended curtain 21 and lighting elements 20. This alternate embodiment limits the use of the invention to pools or bodies of water where bulky objects are not in the way of end users and become a stumbling hazard. One example of these areas of applications are pools where water falls, cascades, or landscaping islands are used around the water edge or perimeter where the supporting base 21 is not in the way of end users. In this embodiment the supporting base 21 could be easily replaced by a poolside decoration of certain sculptured shape such as an animal sculpture, an abstract art piece, or any other object with enough weight to provide an anchoring force and with an exposed surface sufficiently large to accommodate the necessary solar cells 11 exposed to the sunlight to provide the required current for charging the battery 14 (not shown). This alternate bulky shape will provide ample internal room to locate the batteries 14 and the electronic control circuit 12. FIG. 7 shows an example of a tortoise sculpture as a supporting base 21 sitting over a supporting surface 33 where the solar cells 11 are placed over the shell, the suspended curtain 22 hangs from its feet and the remaining components such as batteries 14 and various electronic components will be located inside the housing. Bulky sculptures offer opportunities for locating larger size batteries 14 and complex electronics systems for adding more intensity to the lighting elements 20, remote control and lighting and/or sound effects. Also, the use of bulky sculptures as supporting body 21 may offer the convenience of adding lighting to the sculpture itself. The waterproofing of the electronic components is always required for maintaining the operation and durability of the assembly.

Figure 6:
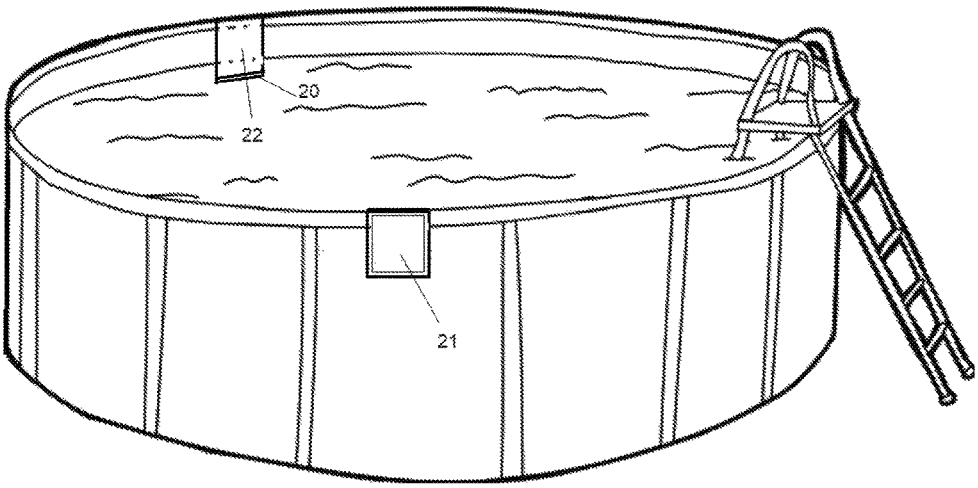
FIG. 6 is a perspective showing the portable lighting system installed on an above ground pool.

Another application for the portable lighting system of the present invention is on above ground pools shown by FIG. 6. In this application the supporting base 21 of the floor mat-like shaped is placed on the top rail of the above ground pool or is hung from the side in a location where it is exposed to sunlight during most of the day. In this application would be advantageous to affix the supporting surface to the external wall of the pool using any form of contact adhesive.

Alternate configurations for the portable pool lighting system object of the present invention, may include replacing the suspended curtain 21 by multiple smaller curtains, nets, flat screens including suction cup holders to hold the screen against the pool walls. The electronic circuit also could be replaced by a more sophisticated units where the LEDS are operated in a way to create a light show within the section. Remote controls may add the human interface if necessary. It is also possible to use the LEDs assemblies containing the required mirrors or lenses to focus the emitted light similarly to certain LED flashlights where the light is concentrated on a target as previously described. Additionally the LED's may be replaced by individual LED's assemblies connected by electrical conductors embedded in a capsule at the bottom end of the suspended curtain.

The foregoing description and accompanying drawings illustrate the principles, exemplary embodiments, and modes of operation of the invention. However, the invention should not be construed as being limited to the embodiments discussed above. Many modifications of the embodiments described herein will come to mind to one skilled in the art having the benefit of the teaching presented in the foregoing descriptions and the associated drawings. Accordingly, it should be appreciated that variations to those embodiments can be made by those skilled in the art without departing from the scope of the invention.

What is claimed is:

1. A solar powered submerged lighting system comprising:

a hollow floor mat;

a suspending structure;

a submersible lighting assembly; and wherein said hollow floor mat further comprising; rechargeable batteries for powering said submersible lighting assembly a solar cells array for charging said rechargeable batteries electronic control elements for electrical Current control and directional interconnections;

at least a light detecting element for signaling said electronic control element on the presence of solar light; and electrical conductors for interconnecting said electronic control elements, said light detecting element, said battery, said solar cell array and said submersible lighting assembly;

wherein said suspending structure having first and second end, wherein said first end Is attached to one edge of said hollow floor mat, and said second end attached to said submersible lighting assembly; said suspending structure further including electrical conductors for electrically connecting said rechargeable batteries with said submersible lighting assembly.

2. The solar powered submerged lighting system of claim 1, wherein said submersible lighting assembly comprises multiple LED elements, holding base, electrical conductors and light projecting lenses.

3. The solar powered submerged lighting system of claim 2, wherein said suspending structure consist of a clear and resilient sheet of plastic material transversely attached to one edge of said hollow floor mat.

4. The solar powered submerged lighting system; of claim 1, wherein said submersible lighting assembly has a luminescent power greater than 300 lumens.

5. The solar powered submerged lighting system of claim 1, wherein said suspending structure is a net-like material attached transversally to an edge of said hollow floor mat.

6. The solar powered submerged lighting system of claim 1, wherein said hollow floor mat further includes a superficial transparent laminar material to allow sunlight to reach said solar cell array.

7. The solar powered submerged lighting system of claim 1, wherein said submersible lighting assembly is non-buoyant, whereby emitted light propagation occurs under water.

8. The solar powered submerged lighting system of claim 1, wherein said suspending structure is an integral appendix of said hollow floor mat, extending from at least one edge of said hollow floor mat.

9. A solar powered submerged lighting system comprising:

a sculpture having a sealed chamber and a supporting base;

a suspending structure; and a submersible lighting assembly for underwater illumination; and wherein said sculpture further including:

rechargeable batteries for powering said submersible lighting assembly, electronic control elements for electrical current control and distribution, solar cell array for charging said rechargeable, batteries, at least one light detecting element for signaling said electronic control elements of the presence of solar light; and electrical conductors for interconnecting said electronic control elements with said battery, said light detecting clement, said solar cell array and said submersible lighting assembly;

wherein said suspending structure having first and second end, wherein said first end is attached to the supporting base of said sculpture, and said second end attached to said submersible lighting assembly; said suspending element further including electrical conductors for electrically connecting said sculpture with said submersible lighting means.

10. The solar powered submerged lighting system of claim 9, wherein said submersible lighting means further comprising at least an LED element, a holding base, electrical conductors and light projecting lenses.

11. The solar powered submerged lighting system of claim 9, wherein said suspending structure is a water permeable membrane attached in at least two points to at least one edge of said sculpture.

12. The solar powered submerged lighting system of claim 9, wherein said suspending structure is a net-like material hanging transversally from said supporting base of said sculpture.

13. The solar powered submerged lighting system of claim 9, wherein said solar cell array is located on an upper surface of said sculpture to gain maximum sun light exposure.

14. The solar powered submerged lighting system of claim 9, wherein said submersible lighting assembly being non-buoyant, whereby emitted light remains under water.

15. The solar powered submerged lighting system of claim 9, wherein said sculpture is non-buoyant.

16. A solar powered submerged lighting system comprising:

a submersible lighting assembly including a plurality of LEDs and light projecting lenses, wherein said submersible lighting assembly has no buoyancy;

a hollow floor mat having an internal chamber, including solar cells, a rechargeable battery, electronic control elements and electrical conductors; and a suspending structure for supporting said submersible lighting assembly at a predetermined depth into a water body, wherein said suspending structure having a first and second end, where said first end is transversally attached to an edge of said floor mat and said second end attached to said submersible lighting assembly.

17. The solar powered submerged lighting system of claim 16, wherein said suspension structure comprises electrical conductors for electrically connecting said submersible lighting assembly with said hollow floor mat.

18. The solar powered submerged lighting system of claim 16, wherein said suspension structure is a water permeable membrane.

* * * * *